US011407078B2

(12) United States Patent
Tang et al.

(10) Patent No.: US 11,407,078 B2
(45) Date of Patent: Aug. 9, 2022

(54) GRINDING MACHINE FOR RAISED JOINTS OF RIVETS ON SHEET METAL

(71) Applicant: JiangXi University of Science and Technology, Jiangxi (CN)

(72) Inventors: Jun Tang, Jiangxi (CN); Ruizhi Luo, Jiangxi (CN); Yuanhui Xie, Jiangxi (CN)

(73) Assignee: JiangXi University of Science and Technology, Gangzhou (CN)

( * ) Notice: Subject to any disclaimer, the term of this patent is extended or adjusted under 35 U.S.C. 154(b) by 723 days.

(21) Appl. No.: 16/443,752

(22) Filed: Jun. 17, 2019

(65) Prior Publication Data

US 2020/0215658 A1 Jul. 9, 2020

(30) Foreign Application Priority Data

Jan. 3, 2019 (CN) ..... 201910004320.7

(51) Int. Cl.
*B24B 19/00* (2006.01)
*B24B 23/02* (2006.01)
*B24B 19/02* (2006.01)

(52) U.S. Cl.
CPC ..... *B24B 19/007* (2013.01); *B24B 23/028* (2013.01); *B24B 19/022* (2013.01)

(58) Field of Classification Search
CPC ..... B24B 19/22; B24B 23/08; B24B 23/043; B24B 19/007; B24B 23/005; B24B 23/03
See application file for complete search history.

(56) References Cited

U.S. PATENT DOCUMENTS 1,921,333 A * 8/1933 Stogner ..... B24B 23/08 451/424
2014/0213160 A1* 7/2014 Page ..... B24B 23/005 451/367

FOREIGN PATENT DOCUMENTS

| | | | |
|---|---|---|---|
| CN | 203330806 | U | 12/2013 |
| CN | 103624647 | B | 5/2016 |
| CN | 207155429 | U | 3/2018 |
| CN | 208051601 | U | 11/2018 |

* cited by examiner

*Primary Examiner* — Anna K Kinsaul
*Assistant Examiner* — Daniel Jeremy Leeds

(57) ABSTRACT

A grinding device for raised joints of rivets on sheet metal is provided, including a lateral plate, legs, a moving plate, first springs, a first bearing seat, a sleeve, a grinding wheel, a moving bar, a 7-shaped plate, a vertical bar, a second spring, an oscillating plate, etc. The legs are fixedly connected, in a symmetric manner, to left and right sides of the bottom of the lateral plate. A through hole, which has a function of guiding, is formed on a left side of the lateral plate. The moving bar is located in the through hole. In the present disclosure, a driving motor is started to rotate the grinding wheel, the grinding device is moved to enable the grinding wheel to be located above a raised joint, and then the oscillating plate is pulled so that the grinding wheel can move downward to grind the raised joint.

5 Claims, 2 Drawing Sheets

GRINDING MACHINE FOR RAISED JOINTS OF RIVETS ON SHEET METAL

CROSS-REFERENCE TO RELATED APPLICATIONS

This application claims the benefit of priority from Chinese Application No. 201910004320.7, filed on Jan. 3, 2019. The content of the aforementioned application, including any intervening amendments thereto, is incorporated herein by reference.

TECHNICAL FIELD

The present invention relates to a grinding device and in particular to a grinding device for riveted joints on sheet metal.

BACKGROUND OF THE PRESENT INVENTION

During the machining process, there may be a large number of rivets on sheet metal. Since the joints of the rivets may be raised, it is necessary to grind the raised joints in order to prevent the raised joints from influencing the subsequent processes. Usually, a grinding device is held by people to grind the raised joints, and people have to move the grinding device correspondingly. Over time, people suffer from arm tension and aches, which will influence the grinding process. Moreover, during the grinding of the raised joints by the grinding device, it is likely for the grinding device to deviate from the raised joints. In this event, the grinding device may come into contact with the sheet metal to damage it. Based on this consideration, people need to have a rest after a short period of time of working with their eyes focused on the raised joints and the grinding device to avoid the deviation of the grinding device from the raised joints. This is effort-saving and the working efficiency is low.

SUMMARY OF THE PRESENT INVENTION

The present invention is intended to overcome the following defects: people have to move the grinding device correspondingly; over time, people suffer from arm tension and aches, which will influence the grinding process; and moreover, during the grinding of the raised joints by the grinding device, it is likely for the grinding device to deviate from the raised joints and in this event, the grinding device may come into contact with the sheet metal to damage it. A technical problem to be solved is to provide a grinding device for riveted joints on sheet metal, which can be used by people to grind raised joints conveniently without causing arm tension and aches, with low possibility of deviation that may cause damage to the sheet metal.

The following technical solution is employed in the present invention. A grinding device for raised joints of rivets on sheet metal is provided, comprising a lateral plate, legs, a moving plate, first springs, a first bearing seat, a sleeve, a grinding wheel, a moving bar, a 7-shaped plate, a vertical bar, a second spring, an oscillating plate, a guide slider and a driving device. The legs are fixedly connected, in a symmetric manner, to left and right sides of the bottom of the lateral plate. A through hole, which has a function of guiding, is formed on a left side of the lateral plate. The moving bar is located in the through hole. The moving plate is fixedly connected to the bottom end of the moving bar.

The first springs are connected between left and right sides of the top of the moving plate and left and right sides of the bottom of the lateral plate. The first spring on the left is located on a right side of the moving bar. The first bearing seat is mounted, in an embedded manner, in the middle of the moving plate. The sleeve is fixedly connected to a bearing in the first bearing seat. The grinding wheel that can grind a joint is mounted on the external bottom of the sleeve. The driving device that can rotate the grinding wheel is arranged between the interior of the sleeve and the middle of the lateral plate. The 7-shaped plate is arranged on a left side of the top of the lateral plate. The vertical bar is mounted on a left side of the internal top of the 7-shaped plate. The oscillating plate is hinged to a bottom end of the vertical bar. A guide chute is formed on a left side of the bottom of the oscillating plat, the guide slider is provided, in a sliding manner, in the guide chute, and the guide slider is slide-fitted in the guide chute. The bottom of the guide slider is hinged to the top end of the moving bar. The second spring is connected between a left side of the top of the oscillating plate and an upper portion of a left side of the vertical bar.

As a preferred technical solution of the present invention, the driving device comprises a second bearing seat, a rotating shaft, a driving motor and vertical sliders. The second bearing seat is arranged, in an embedded manner, in the middle of the lateral plate. The rotating shaft is fixedly connected to a bearing in the second bearing seat, and a lower portion of the rotating shaft is located in the sleeve. Vertical chutes, which have a function of guiding, are formed in lower portions of left and right sides in the sleeve. The vertical sliders are arranged, in a sliding manner, in the vertical chutes, and the vertical sliders are slide-fitted in the vertical chutes. A right side of the vertical slider on the left is fixedly connected to a lower portion of a left side of the rotating shaft, and a left side of the vertical slider on the right is fixedly connected to a lower portion of a right side of the rotating shaft. The driving motor is connected, by bolts, to the middle of the top of the lateral plate. The output shaft of the driving motor is fixedly connected to a top end of the rotating shaft by a coupling.

As a preferred technical solution of the present invention, the grinding device further comprises a fixing device for fixing the oscillating plate. The fixing device comprises a curved ratchet rack, a curved slider, a ratchet block, an oscillating bar, a fastening bolt and a torsion spring. A curved groove is formed on the upper portion of the left side of the 7-shaped plate, and the curved ratchet rack is located in the curved groove. A bottom end of the curved ratchet rack is fixedly connected to the left side of the top of the oscillating plate. A curved chute, which has a function of guiding, is formed in an upper portion of an internal side of the curved ratchet rack. The curved slider is arranged, in a sliding manner, in the curved chute, and the curved slider is slide-fitted in the curved chute. A right side of the curved slider is fixedly connected to the middle of the right side of the curved groove. The oscillating bar is hinged to the upper portion of the external left side of the 7-shaped plate. An upper portion of the oscillating bar is located in the curved groove. The ratchet block is hinged to a lower portion of a right side of the oscillating bar. The ratchet block is meshed with the curved ratchet rack. The torsion spring is arranged at a position where the ratchet block is hinged to the oscillating bar. The fastening bolt is arranged in a lower portion of the oscillating bar. A slot, which is fitted with the fastening bolt, is formed in the lower portion of the external left side of the 7-shaped plate. The slot is located below the curved groove. A right end of the fastening bolt is located in the slot.

As a preferred technical solution of the present invention, the grinding device further comprises slide bars, third springs and curved rubber plates; recesses, which have a function of guiding, are each formed in the middle of the bottom of legs on the left and right. The slide bars are located in the recesses. The third springs are connected between a top end of the slide bars and the top of the recesses. There are two curved rubber plates that can absorb shock on the grinding device, and the curved rubber plates are each arranged on a bottom end of the slide bars on the left and right.

As a preferred technical solution of the present invention, the grinding device further comprises a third bearing seat, a rotating bar, a gear, a blade and a gear ring. The third bearing seat is arranged in a lower portion of a left side of the leg on the right. The rotating bar is fixedly connected to a bearing in the third bearing seat. The blade, which can clear debris, is mounted on a bottom end of the rotating bar. The gear is mounted on a top end of the rotating bar. The gear ring is mounted in a lower portion of an external side of the sleeve. The gear ring is located on a left side of the gear and is meshed with the gear.

The present invention has the following advantages. In the present invention, a driving motor is started to rotate the grinding wheel, the grinding device is moved to enable the grinding wheel to be located above a raised joint, and then the oscillating plate is pulled so that the grinding wheel can move downward to grind the raised joint. It is unnecessary to hold the grinding device by a hand to grind the raised joint. It is both time and effort saving. Moreover, the deviation of the grinding device from the raised joint, which may cause damage to the sheet metal, can be avoided. By the fixing device, the oscillating plate can be fixed, so that people do not have to always pull the oscillating plate. It is convenient and efficient.

BRIEF DESCRIPTION OF THE DRAWINGS

FIG. 2 is an enlarged view of portion A of the present invention, in which:

1: lateral plate;
2: leg;
3: moving plate;
4: first spring;
5: first bearing seat;
6: sleeve;
7: grinding wheel;
8: through hole;
9: moving bar;
10: 7-shaped plate;
11: vertical bar;
12: second spring;
13: oscillating plate;
14: guide chute;
15: guide slider;
16: driving device;
161: second bearing seat;
162: rotating shaft;
163: driving motor;
164: vertical chute;
165: vertical slider;
17: fixing device;
171: curved groove;
172: curved ratchet rack;
173: curved chute;
174: curved slider;
175: ratchet block;
176: oscillating bar;
177: fastening bolt;
178: slot;
179: torsion spring;
18: recess;
19: slide bar;
20: third spring;
21: curved rubber plate;
22: third bearing seat;
23: rotating bar;
24: gear;
25: blade; and
26: gear ring.

DETAILED DESCRIPTION OF THE PRESENT INVENTION

The present invention will be described below in detail with reference to the accompanying drawing by specific embodiments. However, the description is not intended to limit the present invention.

Embodiment 1

Figure 1:
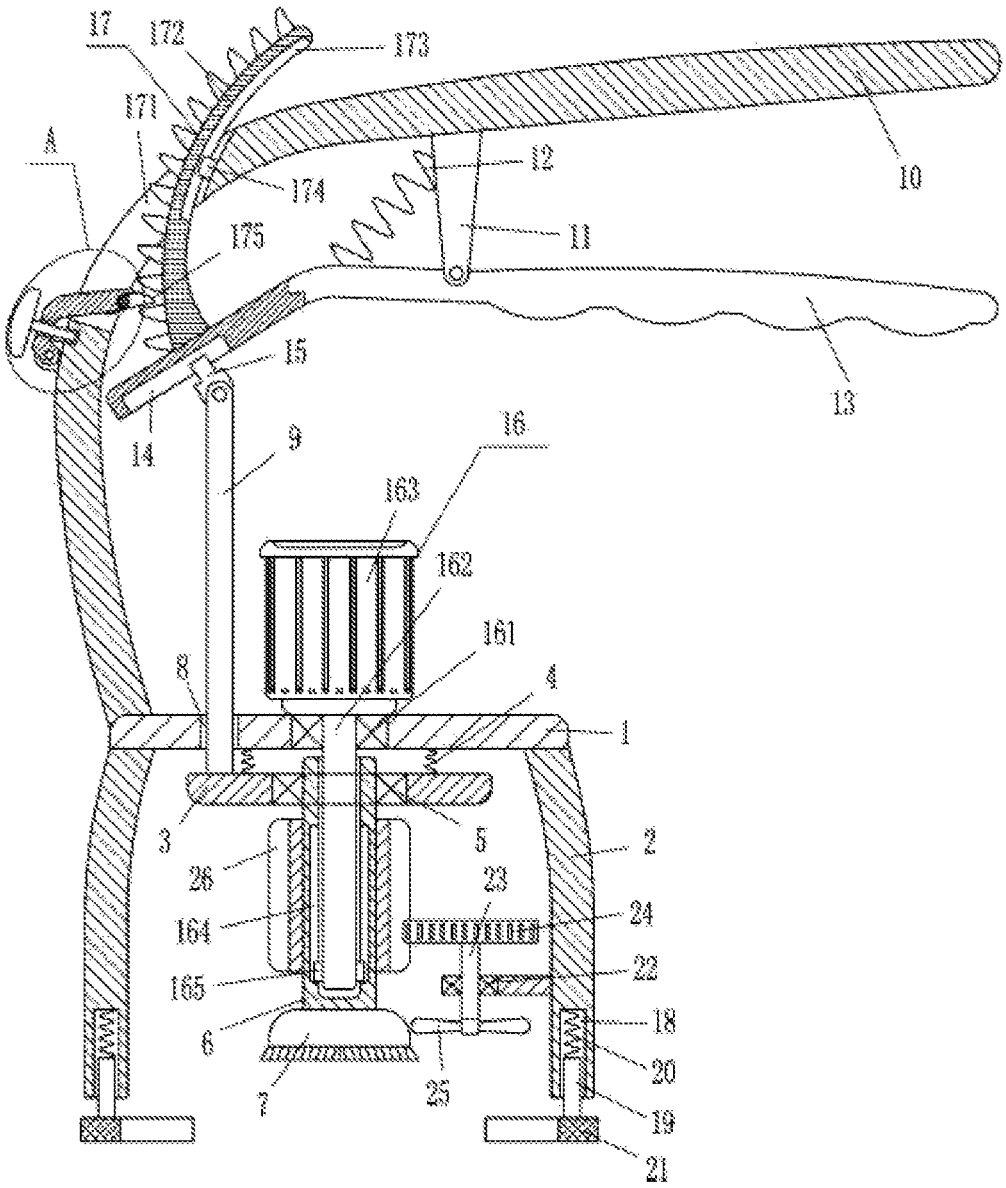
FIG. 1 is a main structural diagram of the present invention.

A grinding device for raised joints of rivets on sheet metal, as shown in FIG. 1, comprises a lateral plate 1, legs 2, a moving plate 3, first springs 4, a first bearing seat 5, a sleeve 6, a grinding wheel 7, a moving bar 9, a 7-shaped plate 10, a vertical bar 11, a second spring 12, an oscillating plate 13, a guide slider 15 and a driving device 16. The legs 2 are fixedly connected, in a symmetric manner, to left and right sides of the bottom of the lateral plate 1. The lateral plate 1 is connected to the legs 2 by bolts. A through hole 8, which has a function of guiding, is formed on a left side of the lateral plate 1. The moving bar 9 is located in the through hole 8. The moving plate 3 is fixedly connected to the bottom end of the moving bar 9. The moving bar 9 is connected to the moving plate 3 by welding. The first springs 4 are connected between left and right sides of the top of the moving plate 3 and left and right sides of the bottom of the lateral plate 1. The first spring 4 on the left is located on a right side of the moving bar 9. The first bearing seat 5 is mounted, in an embedded manner, in the middle of the moving plate 3. The sleeve 6 is fixedly connected to a bearing in the first bearing seat 5. The grinding wheel 7 that can grind a joint is mounted on the external bottom of the sleeve 6. The driving device 16 that can rotate the grinding wheel 7 is arranged between the interior of the sleeve 6 and the middle of the lateral plate 1. The 7-shaped plate 10 is arranged on a left side of the top of the lateral plate 1. The 7-shaped plate 10 is connected to the lateral plate 1 by bolts. The vertical bar 11 is mounted on a left side of the internal top of the 7-shaped plate 10. The oscillating plate 13 is hinged to a bottom end of the vertical bar 11. A guide chute 14 is formed on a left side of the bottom of the oscillating plate 13, a guide slider 15 is provided, in a sliding manner, in the guide chute 14, and the guide slider 15 is slide-fitted in the guide chute 14. The bottom of the guide slider 15 is hinged to the top end of the moving bar 9. The second spring 12 is connected between a left side of the top of the oscillating plate 13 and an upper portion of a left side of the vertical bar 11.

Embodiment 2

A grinding device for raised joints of rivets on sheet metal, as shown in FIG. 1, comprises a lateral plate 1, legs 2, a moving plate 3, first springs 4, a first bearing seat 5, a sleeve 6, a grinding wheel 7, a moving bar 9, a 7-shaped plate 10, a vertical bar 11, a second spring 12, an oscillating plate 13, a guide slider 15 and a driving device 16. The legs 2 are fixedly connected, in a symmetric manner, to left and right sides of the bottom of the lateral plate 1. A through hole 8, which has a function of guiding, is formed on a left side of the lateral plate 1. The moving bar 9 is located in the through hole 8. The moving plate 3 is fixedly connected to the bottom end of the moving bar 9. The first springs 4 are connected between left and right sides of the top of the moving plate 3 and left and right sides of the bottom of the lateral plate 1. The first spring 4 on the left is located on a right side of the moving bar 9. The first bearing seat 5 is mounted, in an embedded manner, in the middle of the moving plate 3. The sleeve 6 is fixedly connected to a bearing in the first bearing seat 5. The grinding wheel 7 that can grind a joint is mounted on the external bottom of the sleeve 6. The driving device 16 that can rotate the grinding wheel 7 is arranged between the interior of the sleeve 6 and the middle of the lateral plate 1. The 7-shaped plate 10 is arranged on a left side of the top of the lateral plate 1. The vertical bar 11 is mounted on a left side of the internal top of the 7-shaped plate 10. The oscillating plate 13 is hinged to a bottom end of the vertical bar 11. A guide chute 14 is formed on a left side of the bottom of the oscillating plate 13, a guide slider 15 is provided, in a sliding manner, in the guide chute 14, and the guide slider 15 is slide-fitted in the guide chute 14. The bottom of the guide slider 15 is hinged to the top end of the moving bar 9. The second spring 12 is connected between a left side of the top of the oscillating plate 13 and an upper portion of a left side of the vertical bar 11.

The driving device 16 comprises a second bearing seat 161, a rotating shaft 162, a driving motor 163 and vertical sliders 165. The second bearing seat 161 is arranged, in an embedded manner, in the middle of the lateral plate 1. The rotating shaft 162 is fixedly connected to a bearing in the second bearing seat 161. The rotating shaft 162 is fixedly connected to a bearing in the second bearing seat 161 by interference fitting. A lower portion of the rotating shaft 162 is located in the sleeve 6. Vertical chutes 164, which have a function of guiding, are formed in lower portions of left and right sides in the sleeve 6. The vertical sliders 165 are arranged, in a sliding manner, in the vertical chutes 164, and the vertical sliders 165 are slide-fitted in the vertical chutes 164. A right side of the vertical slider 165 on the left is fixedly connected to a lower portion of a left side of the rotating shaft 162. The vertical slider 165 is connected to the rotating shaft 162 by welding. A left side of the vertical slider 165 on the right is fixedly connected to a lower portion of a right side of the rotating shaft 162. The driving motor 163 is connected, by bolts, to the middle of the top of the lateral plate 1. An output shaft of the driving motor 163 is fixedly connected to a top end of the rotating shaft 162 by a coupling.

Embodiment 3

Figure 2:
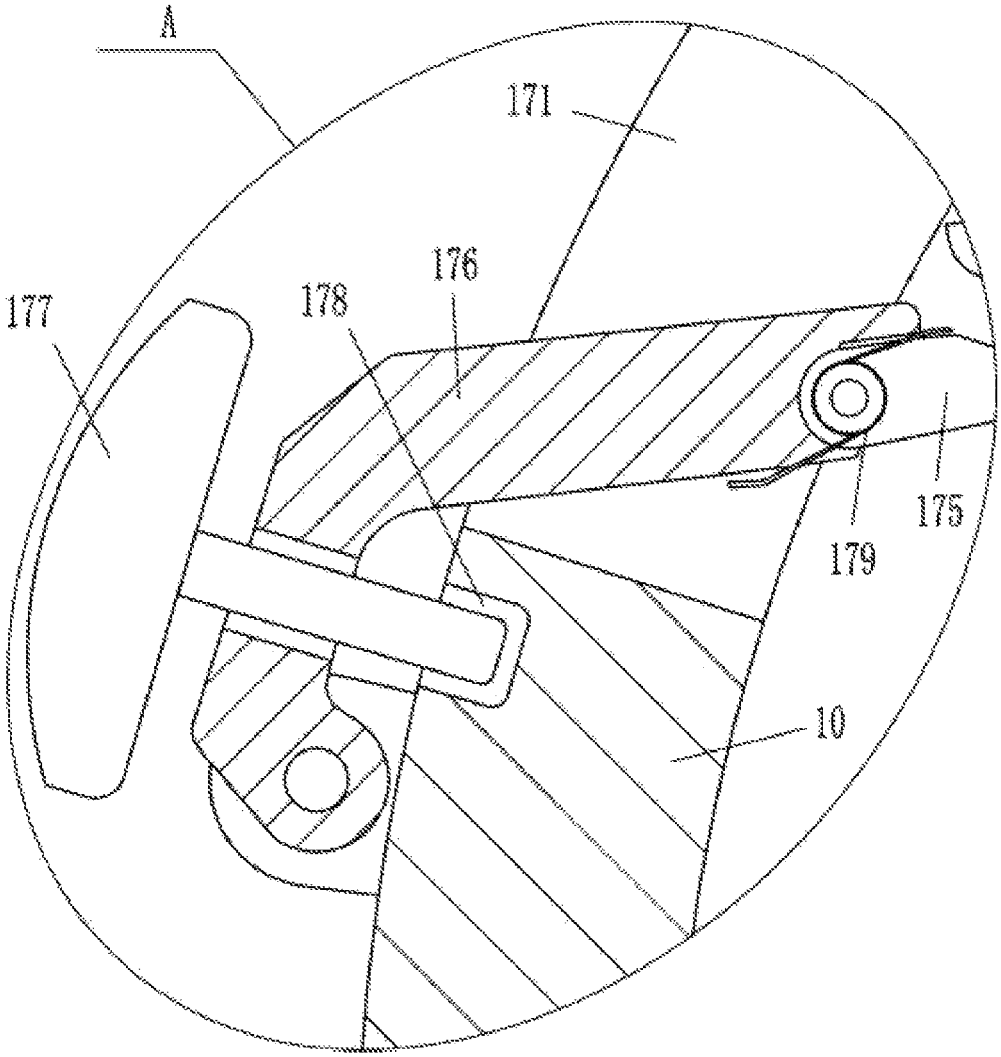

A grinding device for raised joints of rivets on sheet metal, as shown in FIGS. 1-2, comprises a lateral plate 1, legs 2, a moving plate 3, first springs 4, a first bearing seat 5, a sleeve 6, a grinding wheel 7, a moving bar 9, a 7-shaped plate 10, a vertical bar 11, a second spring 12, an oscillating plate 13, a guide slider 15 and a driving device 16. The legs 2 are fixedly connected, in a symmetric manner, to left and right sides of the bottom of the lateral plate 1. A through hole 8, which has a function of guiding, is formed on a left side of the lateral plate 1. The moving bar 9 is located in the through hole 8. The moving plate 3 is fixedly connected to the bottom end of the moving bar 9. The first springs 4 are connected between left and right sides of the top of the moving plate 3 and left and right sides of the bottom of the lateral plate 1. The first spring 4 on the left is located on a right side of the moving bar 9. The first bearing seat 5 is mounted, in an embedded manner, in the middle of the moving plate 3. The sleeve 6 is fixedly connected to a bearing in the first bearing seat 5. The grinding wheel 7 that can grind a joint is mounted on the external bottom of the sleeve 6. The driving device 16 that can rotate the grinding wheel 7 is arranged between the interior of the sleeve 6 and the middle of the lateral plate 1. The 7-shaped plate 10 is arranged on a left side of the top of the lateral plate 1. The vertical bar 11 is mounted on a left side of the internal top of the 7-shaped plate 10. The oscillating plate 13 is hinged to a bottom end of the vertical bar 11. A guide chute 14 is formed on a left side of the bottom of the oscillating plate 13, a guide slider 15 is provided, in a sliding manner, in the guide chute 14, and the guide slider 15 is slide-fitted in the guide chute 14. The bottom of the guide slider 15 is hinged to the top end of the moving bar 9. The second spring 12 is connected between a left side of the top of the oscillating plate 13 and an upper portion of a left side of the vertical bar 11.

The driving device 16 comprises a second bearing seat 161, a rotating shaft 162, a driving motor 163 and vertical sliders 165. The second bearing seat 161 is arranged, in an embedded manner, in the middle of the lateral plate 1. The rotating shaft 162 is fixedly connected to a bearing in the second bearing seat 161. A lower portion of the rotating shaft 162 is located in the sleeve 6. Vertical chutes 164, which have a function of guiding, are formed in lower portions of left and right sides in the sleeve 6. The vertical sliders 165 are arranged, in a sliding manner, in the vertical chutes 164, and the vertical sliders 165 are slide-fitted in the vertical chutes 164. A right side of the vertical slider 165 on the left is fixedly connected to a lower portion of a left side of the rotating shaft 162. A left side of the vertical slider 165 on the right is fixedly connected to a lower portion of a right side of the rotating shaft 162. The driving motor 163 is connected, by bolts, to the middle of the top of the lateral plate 1. An output shaft of the driving motor 163 is fixedly connected to a top end of the rotating shaft 162 by a coupling.

The grinding device further comprises a fixing device 17 for fixing the oscillating plate 13. The fixing device 17 comprises a curved ratchet rack 172, a curved slider 174, a ratchet block 175, an oscillating bar 176, a fastening bolt 177 and a torsion spring 179. A curved groove 171 is formed on the upper portion of the left side of the 7-shaped plate 10, and the curved ratchet rack 172 is located in the curved groove 171. A bottom end of the curved ratchet rack 172 is fixedly connected to the left side of the top of the oscillating plate 13. The curved ratchet rack 172 is connected to the oscillating plate 13 by welding. A curved chute 173, which has a function of guiding, is formed in an upper portion of an internal side of the curved ratchet rack 172. The curved slider 174 is arranged, in a sliding manner, in the curved chute 173, and the curved slider 174 is slide-fitted in the curved chute 173. A right side of the curved slider 174 is fixedly connected to the middle of the right side of the curved groove 171. The oscillating bar 176 is hinged to the upper portion of the external left side of the 7-shaped plate 10. An upper portion of the oscillating bar 176 is located in the curved groove 171. The ratchet block 175 is hinged to a lower portion of a right side of the oscillating bar 176. The ratchet block 175 is meshed with the curved ratchet rack 172. The torsion spring 179 is arranged at a position where the ratchet block 175 is hinged to the oscillating bar 176. The fastening bolt 177 is arranged in a lower portion of the oscillating bar 176. A slot 178, which is fitted with the fastening bolt 177, is formed in the lower portion of the external left side of the 7-shaped plate 10. The slot 178 is located below the curved groove 171. A right end of the fastening bolt 177 is located in the slot 178.

Embodiment 4

A grinding device for raised joints of rivets on sheet metal, as shown in FIGS. 1-2, comprises a lateral plate 1, legs 2, a moving plate 3, first springs 4, a first bearing seat 5, a sleeve 6, a grinding wheel 7, a moving bar 9, a 7-shaped plate 10, a vertical bar 11, a second spring 12, an oscillating plate 13, a guide slider 15 and a driving device 16. The legs 2 are fixedly connected, in a symmetric manner, to left and right sides of the bottom of the lateral plate 1. A through hole 8, which has a function of guiding, is formed on a left side of the lateral plate 1. The moving bar 9 is located in the through hole 8. The moving plate 3 is fixedly connected to the bottom end of the moving bar 9. The first springs 4 are connected between left and right sides of the top of the moving plate 3 and left and right sides of the bottom of the lateral plate 1. The first spring 4 on the left is located on a right side of the moving bar 9. The first bearing seat 5 is mounted, in an embedded manner, in the middle of the moving plate 3. The sleeve 6 is fixedly connected to a bearing in the first bearing seat 5. The grinding wheel 7 that can grind a joint is mounted on the external bottom of the sleeve 6. The driving device 16 that can rotate the grinding wheel 7 is arranged between the interior of the sleeve 6 and the middle of the lateral plate 1. The 7-shaped plate 10 is arranged on a left side of the top of the lateral plate 1. The vertical bar 11 is mounted on a left side of the internal top of the 7-shaped plate 10. The oscillating plate 13 is hinged to a bottom end of the vertical bar 11. A guide chute 14 is formed on a left side of the bottom of the oscillating plate 13, a guide slider 15 is provided, in a sliding manner, in the guide chute 14, and the guide slider 15 is slide-fitted in the guide chute 14. The bottom of the guide slider 15 is hinged to the top end of the moving bar 9. The second spring 12 is connected between a left side of the top of the oscillating plate 13 and an upper portion of a left side of the vertical bar 11.

The driving device 16 comprises a second bearing seat 161, a rotating shaft 162, a driving motor 163 and vertical sliders 165. The second bearing seat 161 is arranged, in an embedded manner, in the middle of the lateral plate 1. The rotating shaft 162 is fixedly connected to a bearing in the second bearing seat 161. A lower portion of the rotating shaft 162 is located in the sleeve 6. Vertical chutes 164, which have a function of guiding, are formed in lower portions of left and right sides in the sleeve 6. The vertical sliders 165 are arranged, in a sliding manner, in the vertical chutes 164, and the vertical sliders 165 are slide-fitted in the vertical chutes 164. A right side of the vertical slider 165 on the left is fixedly connected to a lower portion of a left side of the rotating shaft 162. A left side of the vertical slider 165 on the right is fixedly connected to a lower portion of a right side of the rotating shaft 162. The driving motor 163 is connected, by bolts, to the middle of the top of the lateral plate 1. An output shaft of the driving motor 163 is fixedly connected to a top end of the rotating shaft 162 by a coupling.

The grinding device further comprises a fixing device 17 for fixing the oscillating plate 13. The fixing device 17 comprises a curved ratchet rack 172, a curved slider 174, a ratchet block 175, an oscillating bar 176, a fastening bolt 177 and a torsion spring 179. A curved groove 171 is formed on the upper portion of the left side of the 7-shaped plate 10, and the curved ratchet rack 172 is located in the curved groove 171. A bottom end of the curved ratchet rack 172 is fixedly connected to the left side of the top of the oscillating plate 13. A curved chute 173, which has a function of guiding, is formed in an upper portion of an internal side of the curved ratchet rack 172. The curved slider 174 is arranged, in a sliding manner, in the curved chute 173, and the curved slider 174 is slide-fitted in the curved chute 173. A right side of the curved slider 174 is fixedly connected to the middle of the right side of the curved groove 171. The oscillating bar 176 is hinged to the upper portion of the external left side of the 7-shaped plate 10. An upper portion of the oscillating bar 176 is located in the curved groove 171. The ratchet block 175 is hinged to a lower portion of a right side of the oscillating bar 176. The ratchet block 175 is meshed with the curved ratchet rack 172. The torsion spring 179 is arranged at a position where the ratchet block 175 is hinged to the oscillating bar 176. The fastening bolt 177 is arranged in a lower portion of the oscillating bar 176. A slot 178, which is fitted with the fastening bolt 177, is formed in the lower portion of the external left side of the 7-shaped plate 10. The slot 178 is located below the curved groove 171. A right end of the fastening bolt 177 is located in the slot 178.

The grinding device further comprises slide bars 19, third springs 20 and curved rubber plates 21. Recesses 18, which have a function of guiding, are each formed in the middle of the bottom of legs 2 on the left and right. The slide bars 19 are located in the recesses 18. The third springs 20 are connected between a top end of the slide bars 19 and the top of the recesses 18. The slide bars 19 are connected to the third springs 20 by welding. There are two curved rubber plates 21 that can absorb shock on the grinding device, and the curved rubber plates 21 are each arranged on a bottom end of the slide bars 19 on the left and right. The curved rubber plates 21 are connected to the slide bars 19 by glue.

Embodiment 5

A grinding device for raised joints of rivets on sheet metal, as shown in FIGS. 1-2, comprises a lateral plate 1, legs 2, a moving plate 3, first springs 4, a first bearing seat 5, a sleeve 6, a grinding wheel 7, a moving bar 9, a 7-shaped plate 10, a vertical bar 11, a second spring 12, an oscillating plate 13, a guide slider 15 and a driving device 16. The legs 2 are fixedly connected, in a symmetric manner, to left and right sides of the bottom of the lateral plate 1. A through hole 8, which has a function of guiding, is formed on a left side of the lateral plate 1. The moving bar 9 is located in the through hole 8. The moving plate 3 is fixedly connected to the bottom end of the moving bar 9. The first springs 4 are connected between left and right sides of the top of the moving plate 3 and left and right sides of the bottom of the lateral plate 1. The first spring 4 on the left is located on a right side of the moving bar 9. The first bearing seat 5 is mounted, in an embedded manner, in the middle of the moving plate 3. The sleeve 6 is fixedly connected to a bearing in the first bearing seat 5. The grinding wheel 7 that can grind a joint is mounted on the external bottom of the sleeve 6. The driving device 16 that can rotate the grinding wheel 7 is arranged between the interior of the sleeve 6 and the middle of the lateral plate 1. The 7-shaped plate 10 is arranged on a left side of the top of the lateral plate 1. The vertical bar 11 is mounted on a left side of the internal top of the 7-shaped plate 10. The oscillating plate 13 is hinged to a bottom end of the vertical bar 11. A guide chute 14 is formed on a left side of the bottom of the oscillating plate 13, a guide slider 15 is provided, in a sliding manner, in the guide chute 14, and the guide slider 15 is slide-fitted in the guide chute 14. The bottom of the guide slider 15 is hinged to the top end of the moving bar 9. The second spring 12 is connected between a left side of the top of the oscillating plate 13 and an upper portion of a left side of the vertical bar 11.

The driving device 16 comprises a second bearing seat 161, a rotating shaft 162, a driving motor 163 and vertical sliders 165. The second bearing seat 161 is arranged, in an embedded manner, in the middle of the lateral plate 1. The rotating shaft 162 is fixedly connected to a bearing in the second bearing seat 161. A lower portion of the rotating shaft 162 is located in the sleeve 6. Vertical chutes 164, which have a function of guiding, are formed in lower portions of left and right sides in the sleeve 6. The vertical sliders 165 are arranged, in a sliding manner, in the vertical chutes 164, and the vertical sliders 165 are slide-fitted in the vertical chutes 164. A right side of the vertical slider 165 on the left is fixedly connected to a lower portion of a left side of the rotating shaft 162. A left side of the vertical slider 165 on the right is fixedly connected to a lower portion of a right side of the rotating shaft 162. The driving motor 163 is connected, by bolts, to the middle of the top of the lateral plate 1. An output shaft of the driving motor 163 is fixedly connected to a top end of the rotating shaft 162 by a coupling.

The grinding device further comprises a fixing device 17 for fixing the oscillating plate 13. The fixing device 17 comprises a curved ratchet rack 172, a curved slider 174, a ratchet block 175, an oscillating bar 176, a fastening bolt 177 and a torsion spring 179. A curved groove 171 is formed on the upper portion of the left side of the 7-shaped plate 10, and the curved ratchet rack 172 is located in the curved groove 171. A bottom end of the curved ratchet rack 172 is fixedly connected to the left side of the top of the oscillating plate 13. A curved chute 173, which has a function of guiding, is formed in an upper portion of an internal side of the curved ratchet rack 172. The curved slider 174 is arranged, in a sliding manner, in the curved chute 173, and the curved slider 174 is slide-fitted in the curved chute 173. A right side of the curved slider 174 is fixedly connected to the middle of the right side of the curved groove 171. The oscillating bar 176 is hinged to the upper portion of the external left side of the 7-shaped plate 10. An upper portion of the oscillating bar 176 is located in the curved groove 171. The ratchet block 175 is hinged to a lower portion of a right side of the oscillating bar 176. The ratchet block 175 is meshed with the curved ratchet rack 172. The torsion spring 179 is arranged at a position where the ratchet block 175 is hinged to the oscillating bar 176. The fastening bolt 177 is arranged in a lower portion of the oscillating bar 176. A slot 178, which is fitted with the fastening bolt 177, is formed in the lower portion of the external left side of the 7-shaped plate 10. The slot 178 is located below the curved groove 171. A right end of the fastening bolt 177 is located in the slot 178.

The grinding device further comprises slide bars 19, third springs 20 and curved rubber plates 21. Recesses 18, which have a function of guiding, are each formed in the middle of the bottom of legs 2 on the left and right. The slide bars 19 are located in the recesses 18. The third springs 20 are connected between a top end of the slide bars 19 and the top of the recesses 18. There are two curved rubber plates 21 that can absorb shock on the grinding device, and the curved rubber plates 21 are each arranged on a bottom end of the slide bars 19 on the left and right.

The grinding device further comprises a third bearing seat 22, a rotating bar 23, a gear 24, a blade 25 and a gear ring 26. The third bearing seat 22 is arranged in a lower portion of a left side of the leg 2 on the right. The rotating bar 23 is fixedly connected to a bearing in the third bearing seat 22. The rotating bar 23 is fixedly connected to a bearing in the third bearing seat 22 by interference fitting. The blade 25, which can clear debris, is mounted on a bottom end of the rotating bar 23. The rotating bar 23 is connected to the blade 25 by welding. The gear 24 is mounted on a top end of the rotating bar 23. The gear ring 26 is mounted in a lower portion of an external side of the sleeve 6. The sleeve 6 is connected to the gear ring 26 by welding. The gear ring 26 is located on a left side of the gear 24 and is meshed with the gear 24.

First, the driving device 16 is started by an operator. The operation of the driving device 16 drives the sleeve 6 to rotate. The rotation of the sleeve 6 drives the grinding wheel 7 to rotate. Then, the 7-shaped plate 10 is held to move the grinding device to a position above a raised joint. The legs 2 come into contact with the sheet metal, and the grinding wheel 7 is moved to a position right above the joint. Then, the right portion of the oscillating plate 13 is pulled to oscillate upward, and the upward oscillation of the right portion of the oscillating plate 13 enables its left portion to oscillate downward. The second spring 12 is stretched. The downward oscillation of the left portion of the oscillating plate 13 drives, by the guide slider 15, the moving bar 9 to move downward. The downward movement of the moving bar 9 drives the moving plate 3 to move downward. The first springs 4 are stretched. The downward movement of the moving plate 3 drives the sleeve to move downward. The downward movement of the sleeve 6 drives the grinding wheel 7 to move downward. The downward movement of the grinding wheel 7 provides for the contact with the joint. Then, the grinding wheel 7 rotates to grind the joint. After a joint has been grinded, the oscillating plate 13 may be released. Due to the second spring 12, the left portion of the oscillating plate 13 oscillates upward, and the upward oscillation of the left portion of the oscillating plate 13 drives, by the guide slider 15, the moving bar 9 to move upward to its original position. Due to the first springs 4, the upward movement of the moving plate 3 drives, by the sleeve 6, the grinding wheel 7 to move upward to its original position. That is, the grinding device may be moved to a position above a next joint. By the above operations, the joints may be grinded. When all the raised joints on the sheet metal have been grinded, the driving motor 163 may be turned off First, the driving motor 163 is started by an operator. The rotation of the driving motor 163 drives the rotating shaft 162 to rotate. The rotation of the rotating shaft 162 drives, by the vertical slider 165, the sleeve 6 to rotate. The rotation of the sleeve 6 drives the grinding wheel 7 to rotate. That is, the grinding device may be moved onto the sheet metal, and the grinding wheel 7 may be moved to a position right above a raised joint to start grinding it. When all the raised joints have been grinded, the driving motor 163 may be turned off. Accordingly, the grinding wheel 7 stops rotating.

When the right portion of the oscillating plate 13 is pulled by an operator to oscillate upward, the left portion of the oscillating plate 13 oscillates downward and the downward oscillation of the left portion of the oscillating plate 13 drives the curved ratchet rack 172 to move downward. Due to the torsion spring 179, the curved ratchet rack 172 moves downward and slides on the ratchet block 175. Therefore, the grinding wheel 7 comes into contact with the raised joint. Then, the operator stops pulling the oscillating plate 13, and the oscillating plate 13 is fixed by the fitting of the curved ratchet rack 172 with the ratchet block 175. Then, the oscillating plate 13 is released. When all the raised joints have been grinded, the fastening bolt 177 may be unscrewed by the operator. The fastening bolt 177 is unscrewed to get out of the slot 178. Therefore, the oscillating bar 176 is released by the fastening bolt 177. The oscillating bar 176 is pulled to oscillate leftward. The leftward oscillation of the oscillating bar 176 drives the ratchet block 175 to oscillate leftward. The ratchet block 175 oscillates leftward to separate from the curved ratchet rack 172. Due to the second spring 12, the upward oscillation of the left portion of the oscillating plate 13 drives the curved ratchet rack 172 to move upward to its original position. The oscillating bar 176 is driven to oscillate rightward, and the rightward oscillation of the oscillating bar 176 drives the ratchet block 175 to oscillate rightward. The ratchet block 175 oscillates rightward to mesh with the curved ratchet rack 172. The fastening bolt 177 is screwed into the slot 178 to fix the oscillating bar 176. Then, the screwing of the fastening bolt 177 is stopped. In this way, the operator does not have to pull the oscillating plate 13. It is both time and effort saving.

When the grinding device is placed on the sheet metal, the curved rubber plate 21 comes into contact with the sheet metal. Therefore, when the grinding wheel 7 grinds a raised joint, due to the third springs 20, the curved rubber plate 21 absorbs shock on the grinding device. In this way, the violent shake of the grinding device, which may influence the grinding of the raised joint, can be avoided.

When the driving motor 163 is started, the rotation of the sleeve 6 drives the gear ring 26 to rotate. The rotation of the gear ring 26 drives the gear 24 to rotate. The rotation of the gear 24 drives the rotating bar 23 to rotate. The rotation of the rotating bar 23 drives the blade 25 to rotate. The rotation of the blade 25 generates wind that clears debris produced during the grinding. When the driving motor 163 is turned off, the sleeve 6 stops rotating and the blade 25 also stops rotating. In this way, the accumulation of a great amount of debris, which may influence the grinding, may be avoided.

The foregoing descriptions are merely some implementations of the present invention. It should be noted that, to a person of ordinary skill in the art, various improvements and modifications may be made without departing from the principle of the present invention, and these improvements and modifications shall be deemed as falling into the protection scope of the present invention.

What is claimed is:

1. A grinding device for raised joints of rivets on sheet metal, comprising a lateral plate, legs, a moving plate, first springs, a first bearing seat, a sleeve, a grinding wheel and a moving bar; the legs are fixedly connected, in a symmetric manner, to left and right sides of the bottom of the lateral plate; a through hole, which has a function of guiding, is formed on a left side of the lateral plate; the moving bar is located in the through hole; the moving plate is fixedly connected to the bottom end of the moving bar; the first springs are connected between left and right sides of the top of the moving plate and left and right sides of the bottom of the lateral plate; the first spring on the left is located on a right side of the moving bar; the first bearing seat is mounted, in an embedded manner, in the middle of the moving plate; the sleeve is fixedly connected to a bearing in the first bearing seat; and the grinding wheel that can grind a joint is mounted on the external bottom of the sleeve, wherein the grinding device further comprises a 7-shaped plate, a vertical bar, a second spring, an oscillating plate, a guide slider and a driving device; the driving device that can rotate the grinding wheel is arranged between the interior of the sleeve and the middle of the lateral plate; the 7-shaped plate is arranged on a left side of the top of the lateral plate; the vertical bar is mounted on a left side of the internal top of the 7-shaped plate; the oscillating plate is hinged to a bottom end of the vertical bar; a guide chute is formed on a left side of the bottom of the oscillating plate, a guide slider is provided, in a sliding manner, in the guide chute, and the guide slider is slide-filled in the guide chute; the bottom of the guide slider is hinged to the top end of the moving bar; and the second spring is connected between a left side of the top of the oscillating plate and an upper portion of a left side of the vertical bar.

2. The grinding device for raised joints of rivets on sheet metal according to claim 1, wherein, the driving device comprises a second bearing seat, a rotating shaft, a driving motor and vertical sliders; the second bearing seat is arranged, in an embedded manner, in the middle of the lateral plate; the rotating shaft is fixedly connected to a bearing in the second bearing seat, and a lower portion of the rotating shaft is located in the sleeve; vertical chutes, which have a function of guiding, are formed in lower portions of left and right sides in the sleeve; the vertical sliders are arranged, in a sliding manner, in the vertical chutes, and the vertical sliders are slide-fitted in the vertical chutes; a right side of the vertical slider on the left is fixedly connected to a lower portion of a left side of the rotating shaft, and a left side of the vertical slider on the right is fixedly connected to a lower portion of a right side of the rotating shaft; the driving motor is connected, by bolts, to the middle of the top of the lateral plate; and an output shaft of the driving motor is fixedly connected to a top end of the rotating shaft by a coupling.

3. The grinding device for raised joints of rivets on sheet metal according to claim 2, wherein, the grinding device further comprises a fixing device for fixing the oscillating plate; the fixing device comprises a curved ratchet rack, a curved slider, a ratchet block, an oscillating bar, a fastening bolt and a torsion spring; a curved groove is formed on the upper portion of the left side of the 7-shaped plate, and the curved ratchet rack is located in the curved groove; a bottom end of the curved ratchet rack is fixedly connected to the left side of the top of the oscillating plate; a curved chute, which has a function of guiding, is formed in an upper portion of an internal side of the curved ratchet rack ; the curved slider is arranged, in a sliding manner, in the curved chute, and the curved slider is slide-fitted in the curved chute; a right side of the curved slider is fixedly connected to the middle of the right side of the curved groove; the oscillating bar is hinged to the upper portion of the external left side of the 7-shaped plate; an upper portion of the oscillating bar is located in the curved groove; the ratchet block is hinged to a lower portion of a right side of the oscillating bar; the ratchet block is meshed with the curved ratchet rack; the torsion spring is arranged at a position where the ratchet block is hinged to the oscillating bar; the fastening bolt is arranged in a lower portion of the oscillating bar; a slot, which is fitted with the fastening bolt, is formed in the lower portion of the external left side of the 7-shaped plate; the slot is located below the curved groove; and a right end of the fastening bolt is located in the slot.

4. The grinding device for raised joints of rivets on sheet metal according to claim 3, wherein, the grinding device further comprises slide bars, third springs and curved rubber plates; recesses, which have a function of guiding, are each formed in the middle of the bottom of legs on the left and right; the slide bars are located in the recesses; the third springs are connected between a top end of the slide bars and the top of the recesses; there are two curved rubber plates that can absorb shock on the grinding device, and the curved rubber plates are each arranged on a bottom end of the slide bars on the left and right.

5. The grinding device for raised joints of rivets on sheet metal according to claim 4, wherein the grinding device further comprises a third bearing seat, a rotating bar, a gear, a blade and a gear ring; the third bearing seat is arranged in a lower portion of a left side of the leg on the right; the rotating bar is fixedly connected to a bearing in the third bearing seat; the blade, which can clear debris, is mounted on a bottom end of the rotating bar; the gear is mounted on a top end of the rotating bar; the gear ring is mounted in a lower portion of an external side of the sleeve; and the gear ring is located on a left side of the gear and is meshed with the gear.

* * * * *